US006546992B2

(12) United States Patent
Reusset

(10) Patent No.: US 6,546,992 B2
(45) Date of Patent: Apr. 15, 2003

(54) METHOD AND APPARATUS FOR THE WORKING OF CAVITY WALLS OF CONTINUOUS CASTING MOLDS

(75) Inventor: Christian Reusset, Windisch (CH)

(73) Assignee: Concast Standard AG, Todistrasse (CH)

( * ) Notice: Subject to any disclaimer, the term of this patent is extended or adjusted under 35 U.S.C. 154(b) by 0 days.

(21) Appl. No.: 09/751,324

(22) Filed: Dec. 28, 2000

(65) Prior Publication Data

US 2001/0035279 A1 Nov. 1, 2001

(30) Foreign Application Priority Data

Dec. 29, 1999 (CH) ..... 2394/99

(51) Int. Cl.[7] ..... B22D 31/00; B23C 3/00

(52) U.S. Cl. ..... 164/121; 164/418; 451/27; 409/143

(58) Field of Search ..... 164/418, 459, 164/159, 121; 409/143, 139; 53/113, 82; 451/62, 27, 135

(56) References Cited

U.S. PATENT DOCUMENTS

| | | | | |
|---|---|---|---|---|
| 4,437,526 A | * | 3/1984 | Gloor | 175/346 |
| 4,715,751 A | * | 12/1987 | Rigoulot | 409/139 |
| 4,826,369 A | * | 5/1989 | Bennett | 409/132 |
| 4,878,789 A | * | 11/1989 | Grant | 409/143 |
| 4,923,342 A | * | 5/1990 | Kopkie et al. | 409/143 |
| 4,924,588 A | * | 5/1990 | Stignani et al. | 29/726 |
| 4,936,052 A | * | 6/1990 | Nagase et al. | 51/34 |
| 5,088,237 A | * | 2/1992 | Nagel et al. | 451/156 |
| 5,205,078 A | * | 4/1993 | Takara et al. | 451/11 |
| 5,359,814 A | * | 11/1994 | Baltazar et al. | 451/11 |

FOREIGN PATENT DOCUMENTS

| | | |
|---|---|---|
| DE | 1577330 | 11/1966 |
| DE | 15 77 330 A | 1/1970 |
| DE | 197 47 798 A 1 | 5/1999 |
| EP | 0 498 296 B2 | 1/1992 |

OTHER PUBLICATIONS

Abstract of BR 9 500 402 A.

Excerpt of Database WPI, Section CH, week 199031, Derwent Publications Ltd., London, GB: AN 1987—291583, XP 002150594 & JP.

* cited by examiner

*Primary Examiner*—M. Alexandra Elve
*Assistant Examiner*—Len Tran
(74) *Attorney, Agent, or Firm*—Darby & Darby

(57) ABSTRACT

For the working of walls which bound the cavity of a continuous casting mold, a machine is used which incorporates machining and/or polishing tools. The machine consists of a machine tool table with an arm introducible into the cavity for the supporting of the tools and a table for the clamping of the mold, as well as devices for generating a numerically controlled relative movement between the tools and the walls. In order to obtain a high accuracy in the working also in the case of a cavity with a conicity varying in longitudinal direction and/or along the peripheral line of a cross-section or in the case of a cavity with special corner configurations, it is proposed that a rotational movement of the tools about axes which are arranged substantially obliquely to the longitudinal axis of the arm be combined with a swivelling movement of the arm about its longitudinal axis.

50 Claims, 2 Drawing Sheets

METHOD AND APPARATUS FOR THE WORKING OF CAVITY WALLS OF CONTINUOUS CASTING MOLDS

The invention relates to a method for the working of cavity walls of continuous casting molds.

For the production of continuous casting molds, in particular for the production of the geometry of the mold cavity in the case of tubular billet, bloom and profile formats, various production methods such as cold forming onto a mandrel or machining etc. are known.

The known production methods by means of cold or explosive forming onto a mandrel are expensive, because for each strand cross-section or each conicity shape a mandrel has to be manufactured, which particularly in the case of explosive forming has a short service life. A production by means of machining has its limitations, on the other hand, because the shapes of the mold cavities have become more and more complicated on continuous casting grounds. An additional difficulty is also caused with tubular molds, however, by the small ratio of the clear width to the length of the mold cavity, because the design of the working apparatus is thereby severely limited. In addition to molds with a straight mold cavity and with a casting cone uniform on all sides for a square or circular billet cross-section, molds with curved mold cavities for bow type continuous casting machines are mostly used today, which places an additional limitation on the dimensioning of the working apparatus.

In addition, use is made, in order to improve the strand quality and to increase the casting rate, of moulds with casting conicities varying in the longitudinal direction of the mold, for example with parabolic shape of the casting conicity. A further substantial improvement in the casting rate has been achieved by means of convex molds according to Konvex-Technologie, which is known from EP 0 498 296. In such molds the mold walls are provided on a part of the mold length with convex bulges which in the case of rectangular mold cavities taper into a flat wall, and in the case of circular mold cavities into a circular strand cross-section. In addition, mold cavities are known which exhibit smaller casting conicities in the corner areas than between the corner areas. Such mold cavities are incapable of being produced with known machining machine tools both because of the complex geometry on the one hand and because of poor accessibility in the tabular mold body on the other, and also because of the unfavourable ratio between mold length and clear mold cross-section.

A representative example of a machining machine tool suitable for the working of cavity walls is known for example from DE 1 577 330. DE 1 577 330 discloses a grinding machine for the working of the inner surfaces of steel work's molds, i.e., molds for ingotting. The grinding machine incorporates a supporting arm whose longitudinal axis defines a middle position in a horizontal direction. The supporting arm is supported at one end on a trolley transportable in the direction of the middle position in such a way that the supporting arm is swivellable about a vertical axis and a horizontal axis aligned normal to the longitudinal axis of the supporting arm, and bears at its other end a grinding disc whose axis of rotation is arranged in horizontal direction oblique to the longitudinal axis of the supporting arm. Such an arrangement of the grinding disc permits the working of level inner surfaces, such as are conventional with steel work's molds. Randomly bent inner surfaces, such as are conventional with continuous casting molds, and corner areas between bent inner surfaces may not be worked with the required accuracy with such an arrangement of the grinding disc.

The invention is based on the object of creating a method and an apparatus which are suitable for the inner working of mold tubes for billet, bloom and profile strands. In particular, mold cavities are to be producible with degrees of conicity varying along the mold, with parabolic conicity, with convex side walls, which taper onto a flat wall surface, or with special corner configurations with degrees of conicity of between 0 and 1%/m by machining and polishing work operations with a numerically controlled machine. In addition, a high mold cavity accuracy and surface quality are to be achieved and a cost-effective production method created on the basis of a controlled fabrication process which ensures automatic operation and a high machining rate with optimum chip removal.

The method according to the invention and the apparatus according to the invention make it possible for the first time, by means of a machining machine, to produce mold cavities for billet bloom and profile strands with a conicity varying along the mold, with parabolic conicity or with convexly bulging sidewalls with a numerically controlled machine in addition, it is possible to achieve by means of the method and the apparatus a high mold cavity accuracy and surface quality. Further advantages are a high degree of automation and a high machining rate with optimum chip removal out of the mold cavity. The sum of said advantages leads overall to a cost-effective production method for new molds or to a cost-effective re-working method for used molds and ones re-coated on the cavity side after use.

In Table 1: "Examples of mold cavities" at the end of the text it is intended to demonstrate the multiplicity of ways in which the configurations of mold cavities have developed and will also develop further in future. In addition to the cross-sections shown, tube molds for beam profiles such as "Dogbone" are also to be described as difficult to work.

Molds may be clamped with their longitudinal axis substantially vertically onto a machine tool table and be worked with a vertical tool supporting arm. According to an embodiment it is advantageous if the mold is clamped onto a table with its longitudinal axis horizontally and the tool supporting arm is introduced into the mold cavity substantially horizontally. With such an arrangement the machine advantageously transports the arm with the aid of movement devices in a plane and the table along an axis normal to said plane.

The depth of penetration required for the tool supporting arm in the longitudinal direction of the tube may be reduced and in so doing the accuracy and surface quality of the worked surfaces be improved if, according to an embodiment, the table is after the working of about half the mold length, swivelled through 180° about an axis which runs obliquely to the clamping plane of the table. By means of said additional process step the arm may be designed for a working depth of the mold cavity of 400 to 600 mm, i.e. for roughly half a mold length.

The relative movement between the tool and the mold cavity walls and the rotational movement of the arm about its longitudinal axis may be applied in many different combinations for the machining. According to a further embodiment it is possible in the case of square and circular mold cross-sections for all mold cavity shapes to be worked according to Table 1 if by means of the numerical control in a first step the arm is brought by a rotational movement about its own longitudinal axis into a working position at the mold cavity periphery and clamped and thereafter in a second step with the rotating tool a portion of the mold cavity surface is worked in a simultaneous movement in one, two or three spatial directions. Said sequence of steps may be continued until the whole of the mold cavity exhibits the desired geometry.

The service life of a mold tube may be prolonged quite substantially by repeated coating with a material and a subsequent machining and the mold costs per tonne of cast steel there by be reduced.

In order to improve the freedom of movement of the arm and the tool within the mold cavity, the arm is according to a further embodiment provided with a square cross-section with corner roundings and the tool is fixed at the end of the arm to a special tool holding disc so as to be exchangeable. In order to be able to dimension the cross-section of the arm as generously as possible for a particular mold cavity cross-section, in order on the one hand to increase the bending moment and on the other to prevent vibrations, it is additionally proposed to arrange the axis for the rotational movement of the tool at a distance from the longitudinal centre line of the arm. The distance of the axis of rotation of the tool is advantageously chosen as 10–25% of the diameter of a circle inscribable within the arm cross-section. A further advantageous optimization is obtained if the ratio of the rotational diameter of the tool to the rotational diameter of the arm lies in the range between 1:0.7 and 1:0.9.

In order to achieve a high polishing rate with large-area polishing tools, according to a further embodiment another arm with two axes of rotation arranged substantially obliquely to the longitudinal axis of the arm may be used for two disc-shaped polishing tools.

In order to transfer the drive for the machining and/or polishing tools from the machine tool table up to the axis of rotation of the tool, it is proposed, according to an embodiment, that an axial drive shaft with tooth gears be provided in the arm, in order to obtain a torsion-proof force transmission. A belt drive for the tools is conceivable as an alternative.

BRIEF DESCRIPTION OF THE DRAWINGS

Embodiments of the invention and further advantages of the latter are explained in detail below by means of figures, where

FIGS. 1 and 2 show a machine with an apparatus for the inner working of tubes by means of machining and/or polishing tools, in particular for an inner working in mold cavities of continuous casting molds. A milling or a grinding tool is possible, for example, as a machining tool. The machine consists of a machine tool table 1, which is supported on guides 2 and may be moved in a z-axis by means of a drive. On the machine tool table 1 is arranged a machine head 3, which is raisable and lowerable in a y-axis. The machine head 3 is in addition provided with a device for generating a rotational movement about a horizontal axis 4, as indicated by arrow A. There is couplable to the machine head 3 an arm 6, which is equipped with machining or polishing tools. The arm 6 is, together with the machine head 3, rotatable or swivellable about its longitudinal axis 4, which is arranged horizontally in this example. The arm 6 is easily exchangeable, in order that a tool change between a machining and a polishing tool may be carried out with short shut-off times. A machining or polishing tool 12 fixed to the arm 6 is rotatable about an axis 13. To this end the arm 6 is provided with an axially arranged drive shaft 27 and with a toothed gearing 28 (FIG. 3).

Figure 1:
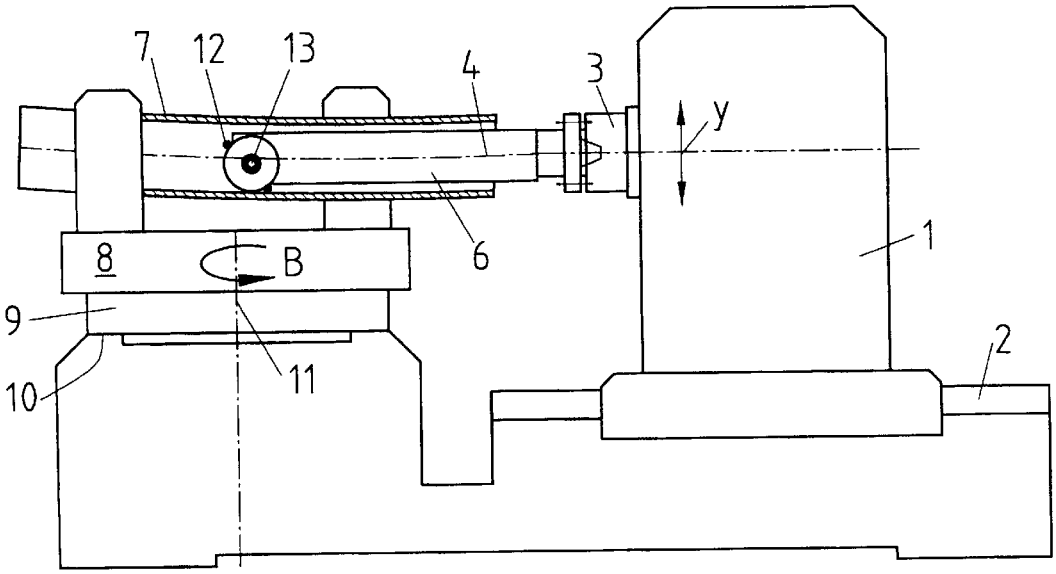
FIG. 1 shows a side view of the apparatus according to the invention, FIG. 2 an overhead view of the apparatus according to FIG. 1, FIG. 3 a side view of an arm with a machining tool, FIG. 4 a view according to arrow IV in FIG. 3, FIG. 5 a view onto an arm with two polishing tools, FIG. 6 a view into a mold cavity with introduced arm with a machining tool and FIG. 7 a view onto a further example of an arm.
Figure 2:
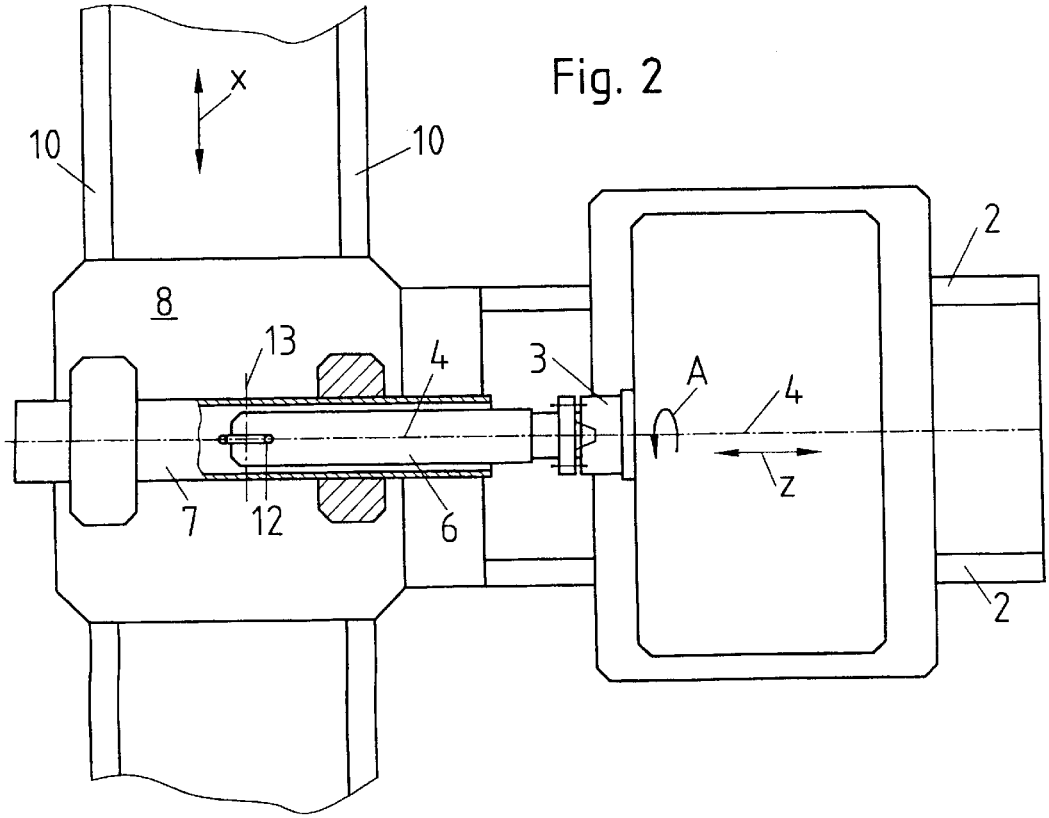

A tubular work-piece, in particular a mold tube 7, is clamped horizontally on a table 8. The table 8 is supported with its stand 9 on guides 10 and is moveable in an x-axis. In addition, the table 8 is swivellable about a vertical axis 11 and may execute a rotational movement B through any angle.

The machine is constructed in such a way that by means of a numerical control system the arm 6 may be moved in the y- and z-axes and simultaneously the table 8 be moved in the x-axis. Likewise simultaneously, the arm 6 may be swivelled about the axis 4 and the tool 12 rotate about an axis 13.

Figure 3:
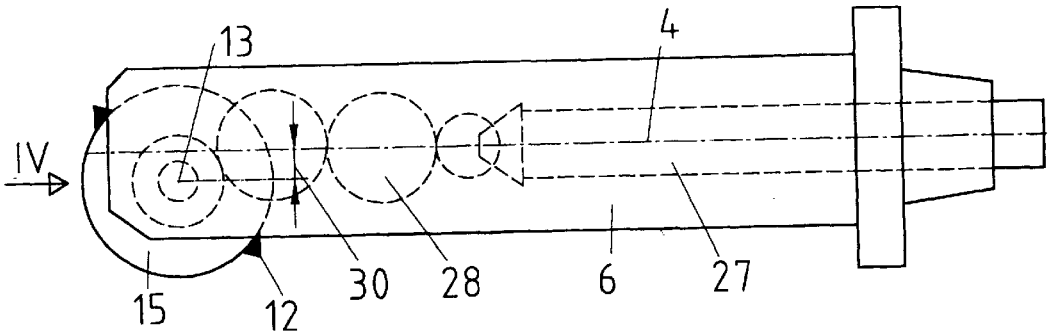
Figure 4:
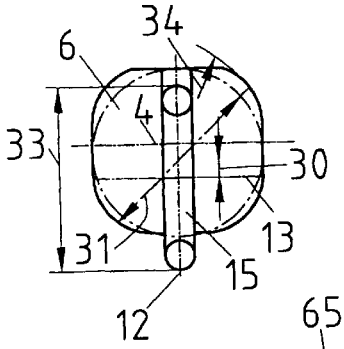

In FIGS. 3 and 4 the arm 6 is provided with a machining tool 12. The cross-section of the arm 6 is substantially square with corner roundings. The tool 12 is fixed so as to be exchangeable at the end of the arm 6 to a tool supporting disc 15. The axis 13 for the rotational movement of the tool 12 is arranged at a distance 30 from the longitudinal centre line 4 of the arm 6. The distance 30 is of the order of magnitude of 10–25% of the diameter 31 of a circle inscribable within the arm cross-section. The rotational diameter 33 of the tool 12 is advantageously chosen as slightly greater than the rotational diameter 34 of the arm 6. A value of between 1:0.7 and 1:0.9 is aimed at as the ratio of the rotational diameter 33 of the tool 12 to the rotational diameter 34 of the arm 6. The length of the arm 6 may be so measured that it is designed for a working length of roughly half a mold length, i.e. for 400–600 mm.

Figure 5:
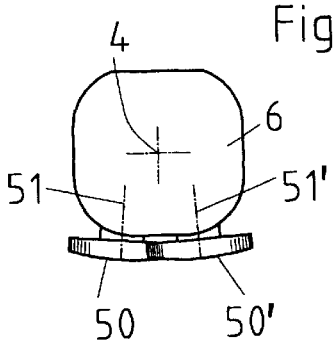

In FIG. 5 an arm 6 is equipped with two polishing tools 50, 50'. Said two tools 50, 50' rotate about axes 51, 51', which are arranged obliquely to the longitudinal axis 4 of the arm 6. Various polishing tools known in the prior art may be used for the polishing.

The working of a new tubular body or of an already used mold re-coated wholly or partly in the mold cavity may be carried out as follows. The tube is clamped onto the table 8 and the arm 6 introduced into the mold cavity. A first half of the length of the mold cavity is worked by numerically controlled combinations of the movements in the x-, y- and z-axes and of the rotation of the machining tool. The rotation of the arm 6 about its longitudinal axis 4 may take place during the working or during an interruption of the working. When the working in the first half of the mold length has been completed, the arm is moved out of the mold cavity and the mold 7 is swivelled, under identical clamping together with the table, through 180° about the vertical table axis 11. The arm 6 is then introduced into the mold cavity once again and the second half of the length of the mold cavity is worked. Prior to a subsequent polishing operation the arm 6 with the machining tool is exchanged for an arm with one or two polishing tools. The polishing also takes place under identical clamping by the mold tube being swivelled one or more times through 180°. The working may be controlled by the numerical control system and/or an adjustment of the tool in such a way that the tool exerts a predetermined contact pressure on the mold wall.

Figure 6:
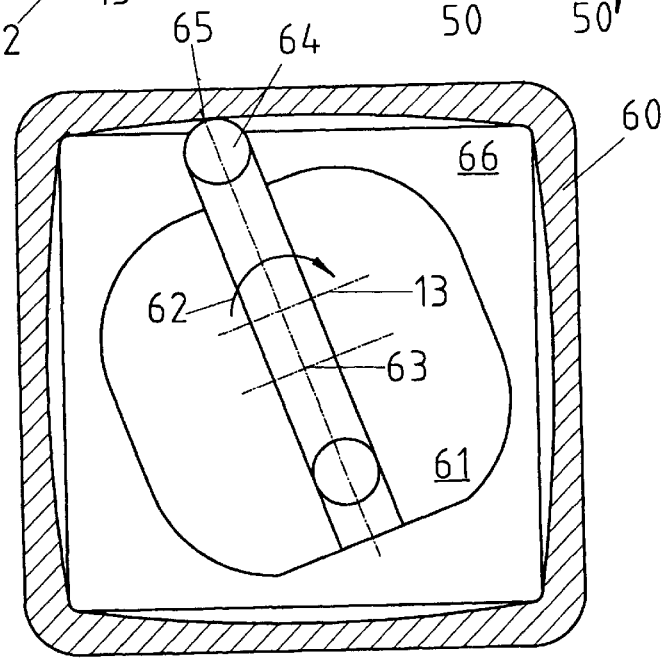

In FIG. 6 is shown a tube 60 with an introduced arm 61 in working position. A mold cavity 66 has the configuration of a convex mold. By a rotation 62 of the arm 61 about its longitudinal axis 63 a miller 64 has been brought into a working position 65 in the cavity 66 and may now perform the working under numerical control. It may be gathered from this figure that mold cavities are workable with a multitude of complex cavity configurations, such as are represented in Table 1 with examples of circular and rectangular cross-sections.

Figure 7:
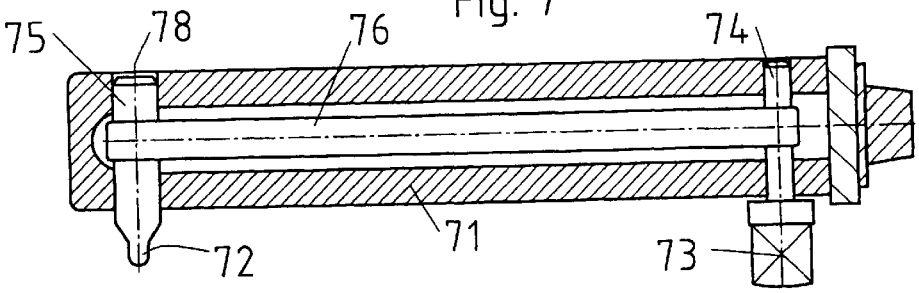

In FIG. 7 an arm 71 is equipped with a milling tool 72 and a drive motor 73 for the milling tool 72. Between the drive shaft 74 and the miller shaft 75 is provided a drive belt 76 or an equivalent drive element. The motor 73 is in said solution flanged directly onto the arm 71 and thus permits an arm construction which is both simple and slim. In operation, said belt drive generates relatively low heat levels, thus permitting a rapid and precise working.

Instead of a horizontal clamping of a mold tube on the table 8, a vertical tube clamping, for example, is also possible. The movements assigned to the tool and to the table in the x-, y- and z-axes may also be selected differently compared with the example described.

In a further embodiment of the apparatus according to the invention it is provided that the axis on which one of the tools is rotatably supported is arranged on the aim in such a way that the alignment of the axis relative to the arm may be changed. For example, the axis could be supported in such a way that it is swivellable in a plane normal to the longitudinal axis. Such a development of the apparatus according to the invention offers additional degrees of freedom, in order to suitably adjust the alignment of the tool relative to a surface to be worked.

For the inner working of mold tubes with mold cavity curved in longitudinal direction it may be advantageous to furnish the arm 6 in its longitudinal direction with a curvature which is adapted to the geometry of the mold cavity. For the fine working of corner areas in the case of molds with a cornered mold cavity, it is advantageous, by means of rotations of the table 8 about the axis 11, to optimize the alignment of the tool provided for the working relative to the spatial arrangement of the respective corner area. Such an optimization leads to improved results during the working of mold cavity walls with a large conicity in the corner areas and/or in the case of molds with a mold cavity curved in longitudinal direction and cornered cross-section.

Table 1 shows 7 examples of the geometry of the peripheries of the cavities of typical continuous casting molds. The examples are arranged in the columns of the table according to the shape of the cross-section of the respective mold: (i) circular cross-sections and (ii) square or rectangular cross-sections. In the rows of the table the examples are arranged according to the nature of the cone, which defines the tapering of the respective cavity (i.e. the shrinking of the cross-sectional area of the cavity) in the longitudinal direction of the mold on a path from the casting side of the mold to the mold outlet. The shape of the respective cone determines how and to what extent the periphery of the cavity is adapted to the shape of a strand which passes through the cavity in the direction of the mold outlet and in so doing is subjected by virtue of a thermally induced shrinkage to a change in shape, measured by the shape of a cross-sectional area of the strand. In the case of the linear cone, of the cone according to Konvex-Technologie and of the parabolic cone there is shown in the respective field of the table: (a) on the left an overhead view of the peripheries of the cavity, viewed in longitudinal direction of the cavity from the inlet side in the direction of the mold outlet, and b) on the right a longitudinal section through the peripheries of the cavity. The cone according to Konvex-Technologie is characterised by the fact that the conicity of the cone is not only variable in the longitudinal direction of the cavity (as with a parabolic cone), but also varies along the peripheral line of a cross-section, particularly as the periphery of the cavity of a mold according to Konvex-Technologie exhibits convex bulges in a longitudinal section on the casting side. Molds with a cone according to Konvex-Technologie are known from EP 0 498 296. The example described in the table as "cone with special corner configuration" relates to a mold known from EP 0 498 296 with a cone according to Konvex-Technologie, in which the cavity exhibits a positive conicity in the middle of the lateral surfaces, in contrast to a negative conicity in the corner areas.

What is claimed is:

1. Apparatus for the working of walls that bound a cavity of a continuous casting mold comprising at least one machining/polishing tools, a table for holding the mold and for clamping of the mold it in a clamping plane, an arm to

TABLE 1

EXAMPLES OF MOULD CAVITIES

| CONE IN LONGITUDINAL DIRECTION | CROSS-SECTION: CIRCULAR | CROSS-SECTION: SQUARE/RECTANGULAR |
|---|---|---|
| LINEAR CONE | 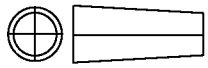 | 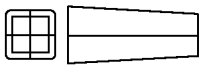 |
| CONE ACCORDING TO KONVEX-TECHNOLOGIE | 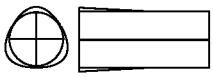 | 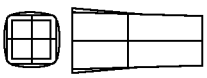 |
| PARABOLIC CONE | 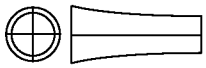 | 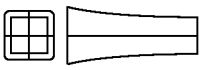 |
| CONE WITH SPECIAL CORNER CONFIGURATION | | 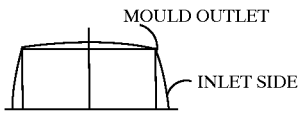  |

which at least one of the tools are attached rotatably relative thereto, an apparatus for generating a rotational movement of each of the tools about respectively an axis arranged substantially obliquely to the longitudinal axis of the arm, an apparatus for moving the arm in such a way that the tools are introducible into the cavity and a relative movement between the tools and the walls is capable of being generated, wherein the apparatus for moving the arm includes a device for generating a rotational movement of the arm about its longitudinal axis and is automatically controlled and a device is provided for swivelling the table for holding the mold about an axis obliquely to the clamping plane of the table, thereby swivelling the mold.

2. Apparatus according to claim 1, wherein the mold is arranged in longitudinal direction along the clamping plane on the table for holding the mold and the arm is arranged on a movable machine tool table.

3. Apparatus according to claim 1, wherein devices are provided for generating simultaneous movements of the table for holding the mold and the arm.

4. Apparatus according to claim 1, wherein the arm, in cross-section, has a substantially square shape with rounded corners, and that the tool is fixed at one end of the arm to a tool supporting disc so as to be exchangeable.

5. Apparatus according to claim 1, wherein the axis for the rotational movement of the tool is arranged at a distance from the longitudinal center line of the arm.

6. Apparatus according to claim 5, wherein the distance of the axis of the tool is about 10 to 25% of the diameter of a circle inscribable within the cross-section of the arm.

7. Apparatus according to claim 1, wherein the arm is designed for a working depth of the cavity of roughly half a mold length.

8. Apparatus according to claim 1, wherein the ratio of the rotational diameter of the tool to the rotational diameter of the arm is between about 1:0.7 and 1:0.9.

9. Apparatus according to claim 1, wherein the apparatus for generating the rotational movement of the tools comprises a drive shaft arranged axially in the arm and toothed gears.

10. Apparatus according to claim 1, wherein the apparatus for generating the rotational movement of the tools includes a belt drive.

11. Apparatus according to claim 1, wherein the arm is bent in the longitudinal direction.

12. Apparatus according to claim 1, wherein the alignment of the axis is changeable relative to the arm.

13. Apparatus according to claim 1, wherein the arm is exchangeable for an equivalent arm including at least one of the tools.

14. Apparatus according to claim 1, including means for controlling the relative movement between the tool and the walls at least partially by adjustment of the tool in such a way that the tool exerts a predetermined contact pressure against one of the walls.

15. Apparatus according to claim 1, wherein the table for holding the mold is swivelable about a vertical axis.

16. Apparatus according to claim 7, wherein the arm is designed for a working depth of the cavity of about 400 to 600 mm.

17. Apparatus according to claim 1, wherein the table for holding the mold is configured such that the mold can be arranged in a longitudinal direction along the clamping plane and the arm is arranged on a movable machine table.

18. Apparatus according to claim 1, having two disc-shaped polishing tools.

19. Apparatus for the working of walls which bound a cavity of a continuous casting mold comprising two disc-shaped polishing tools, a table for holding the mold and for clamping of the mold it in a clamping plane, an arm to which at least one of the tools are attached rotatably relative thereto, an apparatus for generating a rotational movement of each of the tools about respectively an axis arranged substantially obliquely to the longitudinal axis of the arm, and an apparatus for moving the arm in such a way that the tools are introducible into the cavity and a relative movement between the tools and the walls is capable of being generated, wherein the apparatus for moving the arm includes a device for generating a rotational movement of the arm about its longitudinal axis and is automatically controlled.

20. Apparatus according to claim 19, wherein the mold is arranged in longitudinal direction along the clamping plane on the table for holding the mold and the arm is arranged on a movable machine tool table.

21. Apparatus according to claim 19, wherein devices are provided for generating simultaneous movements of the table for holding the mold and the arm.

22. Apparatus according to claim 19, wherein the arm, in cross-section, has a substantially square shape with rounded corners, and that the tool is fixed at one end of the arm to a tool supporting disc so as to be exchangeable.

23. Apparatus according to claim 10, wherein the axis for the rotational movement of the tool is arranged at a distance from the longitudinal center line of the arm.

24. Apparatus according to claim 23, wherein the distance of the axis of the tool is about 10 to 25% of the diameter of a circle inscribable within the cross-section of the arm.

25. Apparatus according to claim 19, wherein the arm is designed for a working depth of the cavity of roughly half a mold length.

26. Apparatus according to claim 19, wherein the ratio of the rotational diameter of the tool to the rotational diameter of the arm is between about 1:0.7 and 1:0.9.

27. Apparatus according to claim 19, wherein the apparatus for generating the rotational movement of the tools comprises a drive shaft arranged axially in the arm and toothed gears.

28. Apparatus according to claim 19, wherein the apparatus for generating the rotational movement of the tools includes a belt drive.

29. Apparatus according to claim 19, wherein the arm is bent in the longitudinal direction.

30. Apparatus according to claim 19, wherein the alignment of the axis is changeable relative to the arm.

31. Apparatus according to claim 19, wherein the arm is exchangeable for an equivalent arm including at least one of the tools.

32. Apparatus according to claim 19, including means for controlling the relative movement between the tool and the walls at least partially by adjustment of the tool in such a way that the tool exerts a predetermined contact pressure against one of the walls.

33. Apparatus according to claim 25, wherein the arm is designed for a working depth of the cavity of about 400 to 600 mm.

34. Apparatus according to claim 19, wherein the table for holding the mold is configured such that the mold can be arranged in a longitudinal direction along the clamping plane and the arm is arranged on a movable machine table.

35. Apparatus for the working of walls which bound a cavity of a continuous casting mold comprising at least one machining/polishing tools, a table for holding the mold and for clamping of the mold it in a clamping plane, an arm to which one or more of the tools are attached rotatably relative thereto, an apparatus for generating a rotational movement of each of the tools about respectively an axis arranged substantially obliquely to the longitudinal axis of the arm, and an apparatus for moving the arm in such a way that the tools are introducible into the cavity and a relative movement between the tools and the walls is capable of being generated, wherein the apparatus for moving the arm includes a device for generating a rotational movement of the arm about its longitudinal axis and is automatically controlled, and wherein the arm is arranged for a working depth of the cavity of approximately half the length of the mold and the table for holding the mold is configured to swivel about 180°.

36. Apparatus according to claim 35, wherein the mold is arranged in longitudinal direction along the clamping plane on the table for holding the mold and the arm is arranged on a movable machine tool table.

37. Apparatus according to claim 35, wherein devices are provided for generating simultaneous movements of the table for holding the mold and the arm.

38. Apparatus according to claim 35, wherein the arm, in cross-section, has a substantially square shape with rounded corners, and that the tool is fixed at one end of the arm to a tool supporting disc so as to be exchangeable.

39. Apparatus according to claim 35, wherein the axis for the rotational movement of the tool is arranged at a distance from the longitudinal center line of the arm.

40. Apparatus according to claim 39, wherein the distance of the axis of the tool is about 10 to 25% of the diameter of a circle inscribable within the cross-section of the arm.

41. Apparatus according to claim 35, wherein the arm is designed for a working depth of the cavity of roughly half a mold length.

42. Apparatus according to claim 35, wherein the ratio of the rotational diameter of the tool to the rotational diameter of the arm is between about 1:0.7 and 1:0.9.

43. Apparatus according to claim 35, wherein the apparatus for generating the rotational movement of the tools comprises a drive shaft arranged axially in the arm and toothed gears.

44. Apparatus according to claim 35, wherein the apparatus for generating the rotational movement of the tools includes a belt drive.

45. Apparatus according to claim 35, wherein the arm is bent in the longitudinal direction.

46. Apparatus according to claim 35, wherein the alignment of the axis is changeable relative to the arm.

47. Apparatus according to claim 35, wherein the arm is exchangeable for an equivalent arm including at least one of the tools.

48. Apparatus according to claim 35, including means for controlling the relative movement between the tool and the walls at least partially by adjustment of the tool in such a way that the tool exerts a predetermined contact pressure against one of the walls.

49. Apparatus according to claim 41, wherein the arm is designed for a working depth of the cavity of about 400 to 600 mm.

50. Apparatus according to claim 35, wherein the table for holding the mold is configured such that the mold can be arranged in a longitudinal direction along the clamping plane and the arm is arranged on a movable machine table.

* * * * *

UNITED STATES PATENT AND TRADEMARK OFFICE

CERTIFICATE OF CORRECTION

PATENT NO. : 6,546,992 B2 
DATED : April 15, 2003
INVENTOR(S) : Christian Reusser It is certified that error appears in the above-identified patent and that said Letters Patent is hereby corrected as shown below:

Title page,
Item [75], Inventor, delete "Christian Reusset" and substitute with -- Christian Reusser --.

Signed and Sealed this

Sixteenth Day of September, 2003

JAMES E. ROGAN
*Director of the United States Patent and Trademark Office*